US011910975B2

(12) United States Patent
Huang et al.

(10) Patent No.: US 11,910,975 B2
(45) Date of Patent: Feb. 27, 2024

(54) CLEANING ROBOT

(71) Applicant: SHENZHEN SILVER STAR INTELLIGENT GROUP CO., LTD., Shenzhen (CN)

(72) Inventors: Shusheng Huang, Shenzhen (CN); Changtai Xia, Shenzhen (CN); Ruijun Yan, Shenzhen (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 597 days.

(21) Appl. No.: 17/006,448

(22) Filed: Aug. 28, 2020

(65) Prior Publication Data

US 2021/0298556 A1 Sep. 30, 2021

(30) Foreign Application Priority Data

Mar. 31, 2020 (CN) ..... 202010247492.X

(51) Int. Cl.
*A47L 11/40* (2006.01)

(52) U.S. Cl.
CPC ..... *A47L 11/4061* (2013.01); *A47L 11/4066* (2013.01); *A47L 11/4072* (2013.01)

(58) Field of Classification Search
CPC ..... A47L 11/4061; A47L 11/4066; A47L 11/4072; A47L 11/24; A47L 11/40;
(Continued)

(56) References Cited

U.S. PATENT DOCUMENTS 10,568,480 B2 * 2/2020 Yim ..... A47L 11/4011
11,478,120 B2 * 10/2022 Jang ..... A47L 11/4013
(Continued)

FOREIGN PATENT DOCUMENTS

CN 107175645 A 9/2017
CN 108030447 A 5/2018
(Continued)

OTHER PUBLICATIONS

English Translation of JP 2001176815 A (Year: 2001).*
(Continued)

*Primary Examiner* — Joel D Crandall
(74) *Attorney, Agent, or Firm* — Dinsmore & Shohl LLP

(57) ABSTRACT

With continued reference to FIGS. 12, 16, and 17, in other embodiments, the collision side plate 13 is provided with a light transmissive portion 132 at a position corresponding to the obstacle avoidance sensor 61, and the at least one obstacle avoidance sensor 61 is hermetically connected to the collision side plate 13. Here, the obstacle avoidance sensor 61 comprises a sensor body 601 and a packaging base 603. The packaging base 603 is hermetically connected to the package side plate, so that a sealed space 605 for accommodating the sensor body 601 is formed between the packaging base 603 and the collision side plate 13. The light transmissive portion 132 can transmit signals emitted and received by the obstacle avoidance sensor 61, and at the same time can provide a dustproof effect to avoid contamination of the sensor body 601 by external dust. The light transmissive portion 132 is formed by a part of the light transmissive member, which can reduce the number of openings in the collision side plate 13, to give a more simplified appearance. One or two or more obstacle avoidance sensors 61 may be provided.

17 Claims, 10 Drawing Sheets

(58) Field of Classification Search
CPC ..... A47L 11/4002; A47L 11/4011; A47L 11/4013; A47L 11/4036; A47L 11/4094; A47L 11/28; A47L 2201/00; A47L 2201/04; A47L 2201/06; A47L 9/009; A47L 9/2836; A47L 9/2894; B25J 9/1676; B25J 9/1694; B25J 11/0085
USPC ..... 15/340.1, 319
See application file for complete search history.

(56) References Cited

U.S. PATENT DOCUMENTS

| | | | | |
|---|---|---|---|---|
| 2001/0015379 | A1* | 8/2001 | Aoki | G06K 7/10623 235/462.43 |
| 2002/0080061 | A1* | 6/2002 | Secker | F41G 7/2226 342/53 |
| 2014/0182627 | A1* | 7/2014 | Williams | A47L 11/4088 134/21 |
| 2014/0188325 | A1* | 7/2014 | Johnson | G05D 1/0227 901/1 |
| 2018/0177361 | A1* | 6/2018 | Song | A47L 9/2852 |
| 2018/0177372 | A1* | 6/2018 | Song | B25J 9/1676 |
| 2018/0184864 | A1* | 7/2018 | Kim | A47L 9/009 |
| 2018/0184872 | A1* | 7/2018 | Kim | A47L 11/4013 |
| 2018/0184873 | A1* | 7/2018 | Kim | A47L 9/2852 |
| 2018/0184874 | A1* | 7/2018 | Song | A47L 9/2894 |
| 2018/0292837 | A1 | 10/2018 | Chen et al. | |
| 2019/0052844 | A1* | 2/2019 | Droz | G01S 17/89 |
| 2020/0019178 | A1 | 1/2020 | Orzechowski et al. | |

FOREIGN PATENT DOCUMENTS

| | | | | | |
|---|---|---|---|---|---|
| CN | 108814422 | A | | 11/2018 | |
| CN | 208179600 | U | | 12/2018 | |
| CN | 110488316 | A | | 11/2019 | |
| CN | 209678392 | U | | 11/2019 | |
| CN | 209678394 | U | | 11/2019 | |
| CN | 210008978 | U | | 2/2020 | |
| CN | 110870719 | A | | 3/2020 | |
| JP | 2001176815 | A | * | 6/2001 | |
| KR | 101623871 | B1 | * | 5/2016 | |
| WO | WO-2005008284 | A1 | * | 1/2005 | G01S 17/58 |
| WO | WO-2019073590 | A1 | * | 4/2019 | A47L 9/009 |

OTHER PUBLICATIONS

English Translation of WO 2019073590 A1 (Year: 2019).*
English Translation of KR 101623871 B1 (Year: 2016).*
China National Intellectual Property Administration (ISA/CN), International Search Report for International Application No. PCT/CN2020/105623, dated Dec. 30, 2020.
China National Intellectual Property Administration (ISA/CN), Written Opinion for International Application No. PCT/CN2020/105623, dated Dec. 30, 2020.
The State Intellectual Property Office of People's Republic of China, First Search issued for Chinese Application No. CN202010247492.X, dated Nov. 9, 2020.
The State Intellectual Property Office of People's Republic of China, First Office Action issued for Chinese Application No. CN202010247492.X, dated Nov. 16, 2020.
The State Intellectual Property Office of People's Republic of China, Second Office Action issued for Chinese Application No. CN202010247492.X, dated Mar. 5, 2021.

* cited by examiner

CLEANING ROBOT

CROSS-REFERENCE TO RELATED APPLICATION

This application claims priority to Chinese Patent Application No. 202010247492X, filed with the Chinese Patent Office on Mar. 31, 2020, entitled "Cleaning Robot", which is incorporated herein by reference in its entirety.

TECHNICAL FIELD

The present disclosure relates to a cleaning robot.

BACKGROUND ART

The current cleaning robots usually scan the surrounding environments by using laser radars (lidar), so as to achieve ranging (distance measurement), obstacle avoidance, mapping, and other functions. The prior art laser radar protrudes from the upper cover of the robot, so that it is convenient for the laser radar to detect the surrounding environment. However, the laser radar exposed to the outside is likely to be hit by obstacles, or splashed by a liquid in the external environment, which affects the service life of the cleaning robot.

SUMMARY

In order to solve the above technical problem, the following technical solution is adopted in an embodiment of the present disclosure:

a cleaning robot, comprising:

a robot body with an inner cavity;

a light transmissive window formed in a side wall of the inner cavity of the robot body;

a travelling mechanism mounted at a bottom of the robot body to drive the robot body to move;

a cleaning component detachably connected to the robot body and configured to clean a surface through which the robot body passes;

a laser radar mounted in the inner cavity, the laser radar comprising a ranging component rotatable relative to the robot body, wherein the ranging component emits and receives laser signals via the light transmissive window within a preset scanning angle, wherein the ranging component emits a detection signal through the light transmissive window, the detection signal is reflected upon encountering an obstacle to form a reflected signal, and the reflected signal is returned to the ranging component through the light transmissive window.

BRIEF DESCRIPTION OF THE DRAWINGS

In order to more clearly illustrate technical solutions of embodiments of the present disclosure or of the prior art, drawings required for use in the description of the embodiments or the prior art will be described briefly below. It is obvious that the drawings in the following description are merely illustrative of some embodiments of the present disclosure. It will be understood by those of ordinary skill in the art that other varied forms can also be obtained from these drawings without any inventive effort.

DETAILED DESCRIPTION OF EMBODIMENTS

Figure 1:
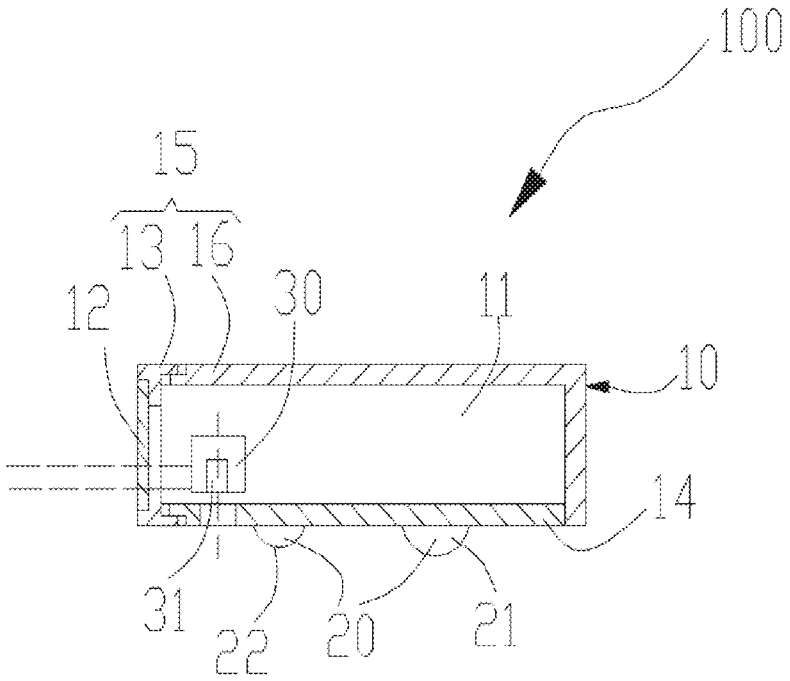
FIG. 1 is a first schematic sectional view of a cleaning robot according to an embodiment of the present disclosure.

The technical solutions of the embodiments of the present disclosure will be described below clearly with reference to the drawings of the embodiments of the present disclosure. It is apparent that the embodiments to be described are merely some, but not all of the embodiments of the present disclosure. All the other embodiments obtained by those of ordinary skill in the art in light of the embodiments of the present disclosure without inventive efforts will fall within the scope of the present disclosure as claimed.

The technical problem to be solved by the present disclosure is to provide a cleaning robot with increased service life.

In order to solve the above technical problem, the following technical solution is adopted in an embodiment of the present disclosure:

A cleaning robot, comprising a robot body, a travelling mechanism, a cleaning component, and a laser radar, wherein the robot body is provided with an inner cavity, a light transmissive window is formed in a side wall of the inner cavity of the robot body, the travelling mechanism is mounted at the bottom of the robot body, to drive the robot body to move, the cleaning component is detachably connected to the robot body, the cleaning component is configured to clean a surface through which the robot body passes, the laser radar is mounted in the inner cavity, the laser radar comprises a ranging component rotatable relative to the robot body, and the ranging component emits and receives laser signals via the light transmissive window within a preset scanning angle, wherein the ranging component emits a detection signal through the light transmissive window, the detection signal is reflected upon encountering an obstacle to form a reflected signal, and the reflected signal is returned to the ranging component through the light transmissive window.

Optionally, the preset scanning angle is greater than or equal to 180°.

Optionally, a plane at the bottom of the robot body is defined as a reference plane, a scanning optical path region is formed by a region through which the laser signals emitted and received by the ranging component pass within the preset scanning angle, the cleaning robot further comprises a sensing component fixedly connected to the robot body, the sensing component is adjacent to the laser radar, and the sensing component is disposed staggered from the scanning optical path region of the ranging component in a direction perpendicular to the reference plane.

Optionally, the sensing component comprises at least one obstacle avoidance sensor, and a distance between the at least one obstacle avoidance sensor and the reference plane is greater than or less than a distance between the scanning optical path region and the reference plane.

Optionally, the robot body comprises a movable collision side plate, in which the light transmissive window is provided, the at least one obstacle avoidance sensor is disposed spaced apart from the collision side plate, and the collision side plate is provided with a light transmissive hole at a position corresponding to the obstacle avoidance sensor, or alternatively, the at least one obstacle avoidance sensor is hermetically connected to the collision side plate, and the collision side plate is provided with a light transmissive portion at a position corresponding to the obstacle avoidance sensor.

Optionally, the sensing component comprises at least one collision detection sensor, and a distance between the at least one collision detection sensor and the reference plane is greater than or less than a distance between the scanning optical path region and the reference plane.

Optionally, the sensing component comprises at least one cliff detection sensor, and a distance between the at least one cliff detection sensor and the reference plane is less than a distance between the scanning optical path region and the reference plane.

Optionally, at least one through hole is provided at a position, corresponding to the laser radar, at the bottom of the robot body, and the at least one cliff detection sensor is mounted in the at least one through hole, respectively.

Optionally, the robot body comprises a chassis, the travelling mechanism comprises a pair of driving wheels disposed on the chassis, the pair of driving wheels is mounted on middle position of the chassis, the laser radar is located at a front end of the chassis, and the laser radar and the pair of driving wheels are distributed in a triangle shape.

Optionally, the travelling mechanism comprises at least one universal wheel disposed on the chassis, and the at least one universal wheel is mounted at a rear end of the chassis opposite to the front end.

Optionally, the cleaning robot further comprises a main circuit board disposed on the chassis, wherein the main circuit board has a front edge adjacent to the laser radar, and the front edge is partially recessed to form a notch, in which the laser radar is at least partially accommodated.

Optionally, the laser radar comprises a housing component fixedly connected to the robot body, and a driving component fixedly connected to the housing component, wherein the driving component can drive the ranging component to rotate, the ranging component comprises a laser emitter and a single photon detection chip, a light emitting path of the laser emitter and a light receiving path of the single photon detection chip are located on a plane perpendicular to a direction of an axis of rotation of the ranging component, and the light emitting path of the laser emitter is parallel to the light receiving path of the single photon detection chip.

Optionally, the laser radar is mounted upright, so that the scanning optical path region of the ranging component is distanced from the reference plane by a first height, or alternatively, the laser radar is mounted upside down, so that the scanning optical path region of the ranging component is distanced from the reference plane by a second height, wherein the second height is less than the first height.

Optionally, the robot body comprise a chassis and an upper cover component, the upper cover component detachably mounted on the chassis, wherein the inner cavity is formed between the chassis and the upper cover component;

wherein the upper cover component comprises a main housing and a collision side plate movably connected to the main housing, the main housing covering the chassis together with the collision side plate, wherein in a position of the collision side plate is expanded relative to the main housing, a space greater than or equal to a stroke of movement of the collision side plate is provided between the collision side plate and the laser radar.

Optionally, the cleaning robot further comprises an elastic member that elastically connects the chassis and the collision side plate, the elastic member providing an elastic supporting force to the collision side plate.

Optionally, the collision side plate is provided with a strip-shaped long hole to allow laser signals emitted and received by the laser radar, a light transmissive member covering the strip-shaped long hole, and at least one reinforcing rib disposed in the strip-shaped long hole.

Optionally, the at least one obstacle avoidance sensor include a first obstacle avoidance sensor and a second obstacle avoidance sensor, and the first obstacle avoidance sensor and the second obstacle avoidance sensor are located on the left and right sides of the laser radar, respectively, and the first obstacle avoidance sensor and the second obstacle avoidance sensor are configured to detect obstacles on the two sides in front of the cleaning robot.

Optionally, the robot body comprise a chassis, and a space is provided between the at least one obstacle avoidance sensor and the chassis, and the scanning optical path region of the ranging component is located within the above space, or alternatively, a space is provided between the scanning optical path region of the ranging component and the chassis, and the at least one obstacle avoidance sensor is located within the above space.

Optionally, the robot body comprise a chassis, and a space is provided between the at least one collision detection sensor and the chassis, and the scanning optical path region of the ranging component is located within the above space, or alternatively, a space is provided between the scanning optical path region of the ranging component and the chassis, and the at least one collision detection sensor is located within the above space.

Optionally, the robot body has an arrangement region overlapping with the scanning optical path region, and the orthographic projection of the sensing component on the chassis is at least partially located within the arrangement region.

Compared with the prior art, the technical solutions of the embodiments of the present disclosure have at least the following advantageous effects:

In an embodiment of the present disclosure, the cleaning robot comprises a robot body, a travelling mechanism, and a laser radar. The robot body is provided with an inner cavity. A light transmissive window is formed in a side wall of the inner cavity of the robot body. Further, the laser radar is mounted in the inner cavity, and the laser radar comprises a ranging component rotatable relative to the robot body, wherein the robot body can achieve the effect of protecting the laser radar from external interference. The ranging component of the laser radar is rotatable safely and stably in the inner cavity. The ranging component emits and receives laser signals via the light transmissive window within a preset scanning angle. The cleaning robot can operate continuously and stably by using the laser radar. Thus, the cleaning robot can operate with stable performance and high reliability and with an advantageously increased service life.

Referring to FIGS. 1 to 6, an embodiment of the present disclosure provides a cleaning robot 100. The cleaning component 100 comprises a robot body 10, a travelling mechanism 20, a cleaning component 80, and a laser radar 30. The robot body 10 is provided with an inner cavity 11. A light transmissive window 12 is formed in a side wall of the inner cavity 11 of the robot body 10. The travelling mechanism 20 is mounted at the bottom of the robot body 10 to drive the robot body 10 to move. The cleaning component 80 is detachably connected to the robot body 10. The cleaning component 80 is configured to clean a surface through which the robot body 10 passes. The laser radar 30 is mounted in the inner cavity 11. The laser radar 30 comprises a ranging component 31 rotatable relative to the robot body 10. The ranging component 31 emits and receives laser signals via the light transmissive window 12 within a preset scanning angle, wherein the ranging component 31 emits a detection signal through the light transmissive window 12, the detection signal is reflected upon encountering an obstacle to form a reflected signal, and the reflected signal is returned to the ranging component 31 through the light transmissive window 12.

Compared with the prior art, the technical solution of an embodiment of the present disclosure has at least the following advantageous effects:

In an embodiment of the present disclosure, the cleaning robot 100 comprises a robot body 10, a travelling mechanism 20, and a laser radar 30. The robot body 10 is provided with an inner cavity 11. A light transmissive window 12 is formed in a side wall of the inner cavity 11 of the robot body 10. Further, the laser radar 30 is mounted in the inner cavity 11, and the laser radar 30 comprises a ranging component 31 rotatable relative to the robot body 10, wherein the robot body 10 can achieve the effect of protecting the laser radar 30 from external interference. The ranging component 31 of the laser radar 30 is rotatable safely and stably in the inner cavity 11. The ranging component 31 emits and receives laser signals via the light transmissive window 12 within a preset scanning angle X. The cleaning robot 100 can operate continuously and stably by using the laser radar 30. Thus, the cleaning robot can operate with stable performance and high reliability and with an advantageously increased service life.

It can be understood that the cleaning robot 100 may be any one of a floor sweeping robot, a floor mopping robot, a window cleaning robot, a vacuuming robot, or the like, and is not limited herein.

In this embodiment, the robot body 10 may comprise a chassis 14 and an upper cover component 15. The upper cover component 15 is detachably mounted to the chassis 14, to protect various functional components inside the cleaning robot 100 from violent collision or damage by an inadvertently spilled liquid during use. The chassis 14 and/or the upper cover component 15 is configured to carry and support the various functional components. In an optional embodiment, the main body of the cleaning robot 100 may have other designed configurations. For example, the main body is in an integrally molded structure, or a structure with left and right parts disposed separately. The material, shape, structure, and so on of the main body are not limited in the embodiment of the present disclosure.

The inner cavity 11 is formed between the chassis 14 and the upper cover component 15, and the inner cavity 11 is configured to provide an arrangement space for the devices inside the cleaning robot 100. A dust collecting box, a vacuum pump, a battery, a main circuit board, a cliff detection sensor, a collision detection sensor, a wall following sensor, and other devices are arranged in the inner cavity 11 of the cleaning robot 100. The upper cover component 15 comprises a main housing 16 and a collision side plate 13 movably connected to the main housing 16. The main housing 16 is a main part of the upper cover component 15. Buttons or keys may be disposed on or in the main housing 16. The main housing 16 covers the chassis 14 together with the collision side plate 13. The main housing 16 is fixedly connected to the chassis 14 by means of screw connection or the like. The collision side plate 13 is movable relative to the chassis 14 and the main housing 16. The cleaning robot 100 further comprises an elastic member that elastically connects the chassis 14 and the collision side plate 13. The elastic member can provide an elastic supporting force to the collision side plate 13. When the collision side plate 13 collides with an obstacle, the collision side plate may be retracted relative to the main housing 16, and then the collision side plate 13 is expanded relative to the main housing 16 under the action of the elasticity of the elastic member. The collision side plate 13 may be in any shape such as an arc shape, a ring shape, a U shape, or the like, which may be set according to actual requirements and is not limited herein.

The light transmissive window 12 is provided in the collision side plate 13, and the front end of the chassis 14 is disposed near the light transmissive window 12. The laser radar 30 is located at the front end of the chassis 14 and is adjacent to the collision side plate 13. The laser radar 30 may be fixed to the chassis 14 or fixed to the main housing 16. In a state where the collision side plate 13 is expanded relative to the main housing 16, a spacing greater than or equal to a stroke of movement of the collision side plate 13 is provided between the collision side plate 13 and the laser radar 30, in order to avoid collision and damage of the laser radar 30 by the collision side plate 13.

The travelling mechanism 20 is connected to the robot body 10 and configured to drive the cleaning robot 100 to move on the ground. For example, the cleaning robot 100 may be designed to autonomously plan a path on the ground, or may be designed to move on the ground in response to a remote control instruction. In an embodiment of the present disclosure, the travelling mechanism 20 comprises two driving wheels 21, at least one universal wheel 22, and a motor for driving the wheels to rotate. The two driving wheels 21 and the universal wheel 22 protrude at least partially from the bottom of the chassis 14. For example, the two wheels may be partially hidden in the chassis 14 under the action of the weight of the cleaning robot 100 itself. In an optional embodiment, the travelling mechanism 20 may also include any one of a triangular crawler wheel, a Mecanum wheel, and the like.

The cleaning robot 100 may comprise a cleaning component 80, detachably connected to the robot body 10. The cleaning component 80 includes one or both of a middle sweeping component and a mopping and wiping component. The middle sweeping component comprises at least one middle sweeping brush. The at least one middle sweeping brush may include one or both of a middle sweeping bristle brush and a middle sweeping rubber brush. The at least one middle sweeping brush may be disposed in an accommodating groove provided at the bottom of the chassis 14. The accommodating groove is provided therein with a dust suction port. The dust suction port communicates with a dust collecting box and a dust suction fan, so that dust and garbage on the ground are stirred up when the middle sweeping bristle brush is rotated, and a suction force is generated by the dust suction fan to suck the dust and garbage from the dust suction port into the dust collecting box. The mopping and wiping component comprises a bracket detachably connected to the chassis 14 and a wiper attached to the bracket. The wiper is configured to fit a surface to be cleaned, and the wiper is moved with the robot body 10 and wipes the surface through which it passes.

The laser radar 30 may be a mechanical laser radar or a solid-state laser radar and may be set as required. In this embodiment, the laser radar 30 is a mechanical laser radar, and the laser radar 30 is a 2D TOF radar, which measures a distance using the time-of-flight principle. The laser radar 30 comprises a housing component 32 fixedly connected to the robot body 10, and a driving component 33 fixedly connected to the housing component 32. The driving component 33 can drive the ranging component 31 to rotate. The ranging component 31 comprises a laser emitter 34 and a single photon detection chip 35. A light emitting path of the laser emitter 34 and a light receiving path of the single photon detection chip 35 are located on a plane perpendicular to a direction of an axis of rotation of the ranging component 31, and the light emitting path of the laser emitter 34 is parallel to the light receiving path of the single photon detection chip 35. In other embodiments, the laser radar 30 may be a triangulation ranging radar.

Here, the driving component 33 can drive the ranging component 31 to rotate, wherein the ranging component 31 comprises a laser emitter 34 and a single photon detection chip 35. The laser emitter 34 may emit a detection light signal, the single photon detection chip 35 may receive a reflected light signal reflected by an obstacle, and the laser radar 30 may achieve two-dimensional ranging according to the time-of-flight ranging principle. A detection chip with a large photosensitive area or a plurality of detection chips or a focus-adjustable light transmissive member is usually used to improve the ability of the laser radar 30 to detect reflected light, but it will result in an increase in system complexity and in size of the laser radar 30. In contrast, in the present disclosure, a small-sized single photon detection chip 35 is used, and the light emitting path of the laser emitter 34 is parallel to the light receiving path of the single photon detection chip 35, thus the space occupied by the ranging component 31 is greatly compressed, and hence the radar size is reduced. Here, the small-sized single photon detection chip 35 has high photoelectric gain, so that the ability of the laser radar 30 to detect reflected light signals is significantly improved, and the ranging effect can be ensured without adding complicated circuit devices. Therefore, the laser radar 30 has a small size and does not occupy too much internal space of the robot body 10.

Here, the housing component 32 comprises a base 321 and a light transmissive cover 322 covering the base 321. The light transmissive cover 322 may be fixed relative to the base 321. In the case where the light transmissive cover 322 is fixed relative to the base 321, the light transmissive cover 322 may be fixedly connected to the base 321 by means of screw connection, glue bonding, threaded connection, or the like, and the light transmissive cover 322 may be hermetically connected to the base 321. Detection light beams emitted and reflected light beams received by the ranging component may pass through the light transmissive cover 322.

A cavity 323 is formed between the base 321 and the light transmissive cover 322, and the cavity 323 may provide installation space and movement space for the ranging component 31 and the driving component 33 of the laser radar 30. The driving component 33 is mounted to the base 321 and in driving connection with the ranging component 31.

In this embodiment, the driving component 33 comprises a motor stator and a motor rotor. The motor stator and the motor rotor may constitute a structurally compact brushless motor, which occupies small space. The motor stator is fixedly mounted to the base 321, and the motor rotor is fixedly mounted to the ranging component 31. The central axis of the motor stator, the central axis of the motor rotor, and the rotation axis of the ranging component 31 coincide with one another. The motor stator can drive the motor rotor to rotate relative to the base 321 by an electromagnetic force, thereby driving the ranging component 31 to rotate relative to the base 321.

In other embodiments, the driving component 33 may comprise a motor and a transmission member. The motor is fixed to the base 321, the transmission member is in transmission connection between the ranging component 31 and a drive shaft of the motor, and the transmission member may be a conveyor belt or a gear, so that the motor can drive the ranging component 31 to rotate via the transmission member.

Figure 6:
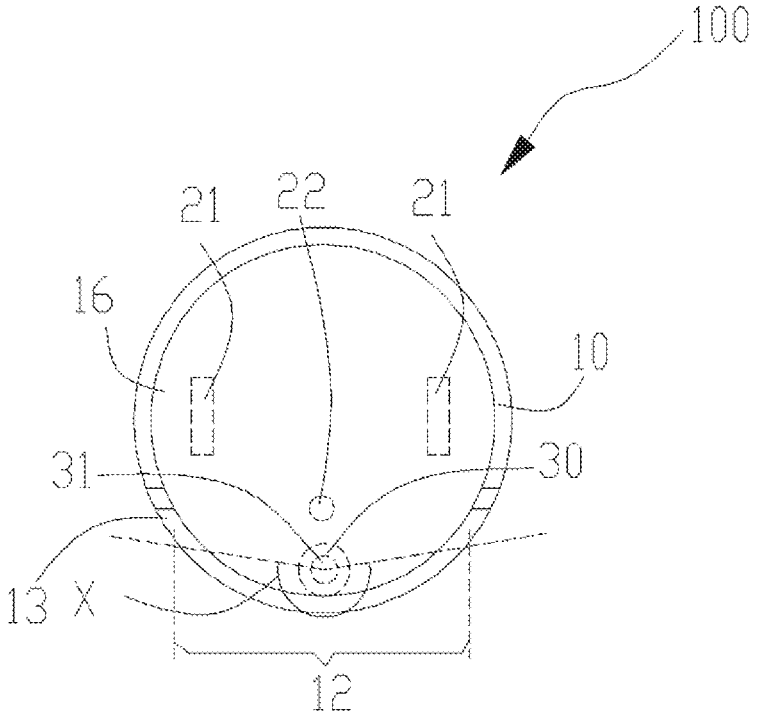
FIG. 6 is a first schematic structural top view of a cleaning robot according to an embodiment of the present disclosure.

Referring to FIGS. 1 and 6, optionally, the pair of driving wheels 21 is mounted at middle position of the chassis 14, the laser radar 30 is located at the front end of the chassis 14, and the laser radar 30 and the pair of driving wheels 21 are distributed in a triangular shape. Here, the laser radar 30 is located at the front end of the chassis 14. There is a small spacing between the laser radar 30 and the collision side plate 13, so that it is convenient for the laser radar 30 to emit and receive laser signals directly through the light transmissive window 12 of the collision side plate 13, and blockage of the laser signals by other components is reduced. A preset distance is set between the laser radar 30 and the direction of a line connecting the pair of driving wheels 21, which can provide space for installation of a circuit board, a motor, a battery, and the like. The laser radar 30 may be fixed to the chassis 14 or to the main housing 16, so that the position of the laser radar 30 is relatively fixed.

Figure 7:
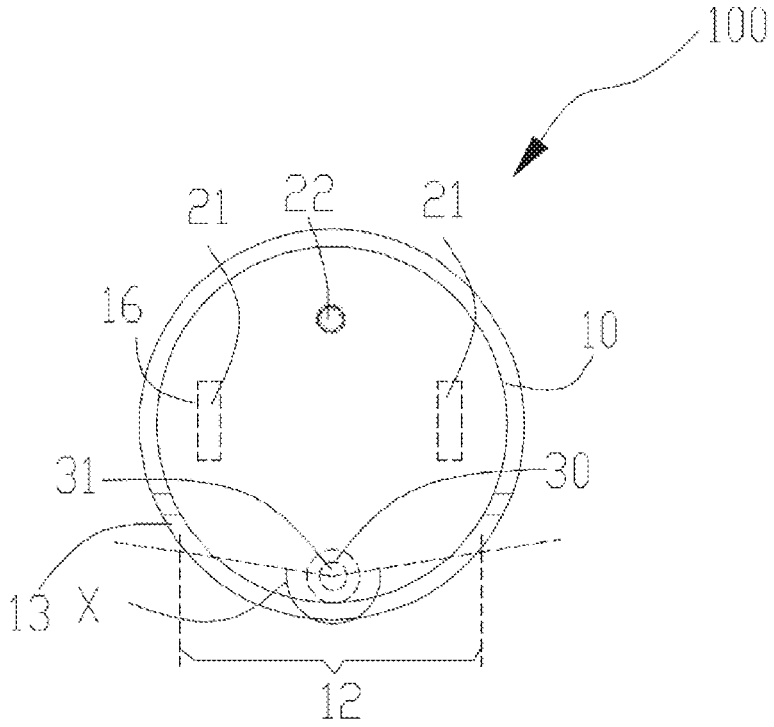
FIG. 7 is a schematic structural top view of a cleaning robot according to another embodiment.

Referring to FIGS. 1 and 7, optionally, the travelling mechanism 20 comprises at least one universal wheel 22 disposed on the chassis 14, and the at least one universal wheel 22 is mounted at the rear end of the chassis 14 opposite to the front end.

In this embodiment, the at least one universal wheel 22 is mounted at the rear end of the chassis 14 opposite to the front end. In other words, the at least one universal wheel 22 is located on a side of the pair of driving wheels 21 away from the laser radar 30. The chassis 14 is provided with at least one positioning structure cooperating with the at least one universal wheel 22. The positioning structure is protrudingly disposed in the inner cavity 11 and is located on a side of the pair of driving wheels 21 away from the laser radar 30, so that interference of the laser radar 30 with the universal wheel 22 and the positioning structure can be avoided. Here, one or two or more universal wheels 22 may be provided, and the number of the universal wheels may be set according to actual requirements.

Referring to FIGS. 1 and 6, in other embodiments, the at least one universal wheel 22 is mounted at the front end of the chassis 14, and the at least one universal wheel 22 is adjacent to the laser radar 30. Moreover, when a line connecting the centers of the pair of driving wheels 21 is taken as a reference line, a distance between the at least one universal wheel 22 and the reference line is less than a distance between the laser radar 30 and the reference line, and a distance between the positioning structure on the chassis 14 and the reference line is less than the distance between the laser radar 30 and the reference line, so that the above-mentioned positioning structure is staggered from the laser radar 30, so as to avoid interference problems.

Figure 8:
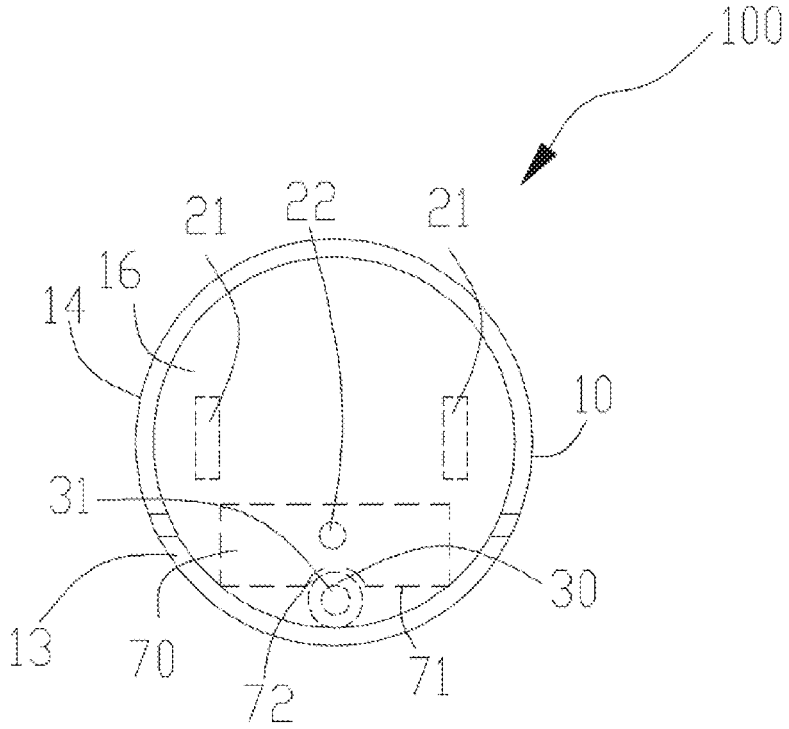
FIG. 8 is a second schematic structural top view of a cleaning robot according to an embodiment of the present disclosure.

Referring to FIGS. 1 and 8, optionally, the cleaning robot 100 further comprises a main circuit board 70 disposed on the chassis 14. The main circuit board 70 has a front edge 71 adjacent to the laser radar 30, and the front edge 71 is partially recessed to form a notch 72, in which the laser radar 30 is at least partially accommodated. Here, the main circuit board 70 is electrically connected to the travelling mechanism 20, the laser radar 30, and the battery and the motor on the chassis 14, and so on. The main circuit board 70 is disposed near the collision side plate 13 and the laser radar 30. The notch 72 is provided in the main circuit board, so that an accommodating space can be provided for the laser radar 30 by the notch 72 without shifting the entire main circuit board 70 backward.

Referring to FIGS. 1 and 6, optionally, the preset scanning angle X is greater than or equal to 180°. In this embodiment, the ranging component 31 is rotatable by 360° relative to the robot body 10. The ranging component 31 may emit a laser detection signal at a preset frequency within the preset scanning angle X, the above laser detection signal is reflected by an external obstacle to form a laser reflected signal, and the above laser reflected signal is returned to the laser radar 30, wherein both of the laser detection signal and the laser reflected signal described above should pass through the light transmissive window 12. Since the laser radar 30 is located in the inner cavity 11, the laser radar 30 cannot achieve a laser scanning angle of 360 degrees in normal operation. In other words, the preset scanning angle X is less than 360°. In some optional embodiments, the preset scanning angle X is greater than or equal to 230° and less than 360°. Naturally, in other embodiments, the preset scanning angle X may also be less than 230°.

Figure 2:
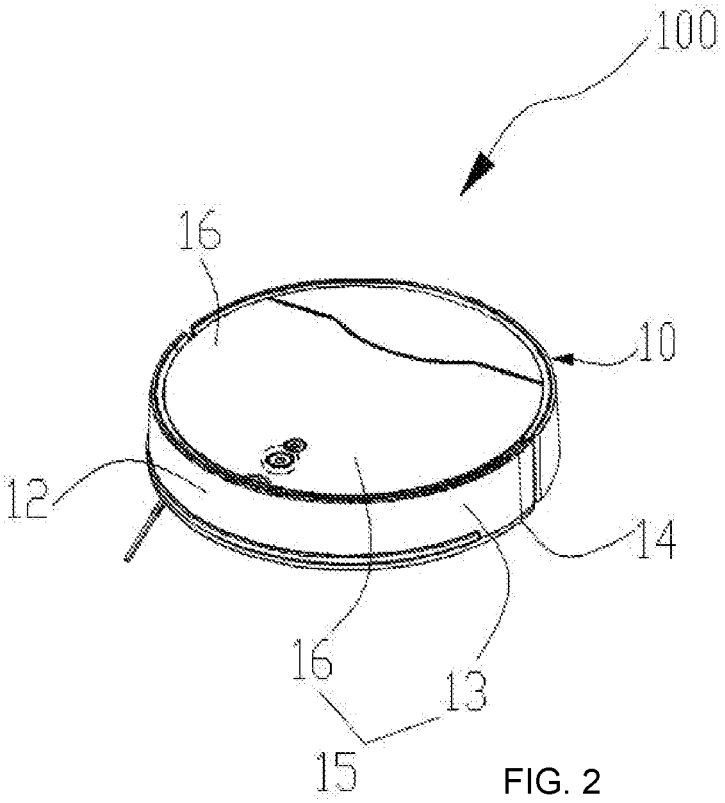
FIG. 2 is a schematic structural perspective view of a cleaning robot according to an embodiment of the present disclosure.
Figure 3:
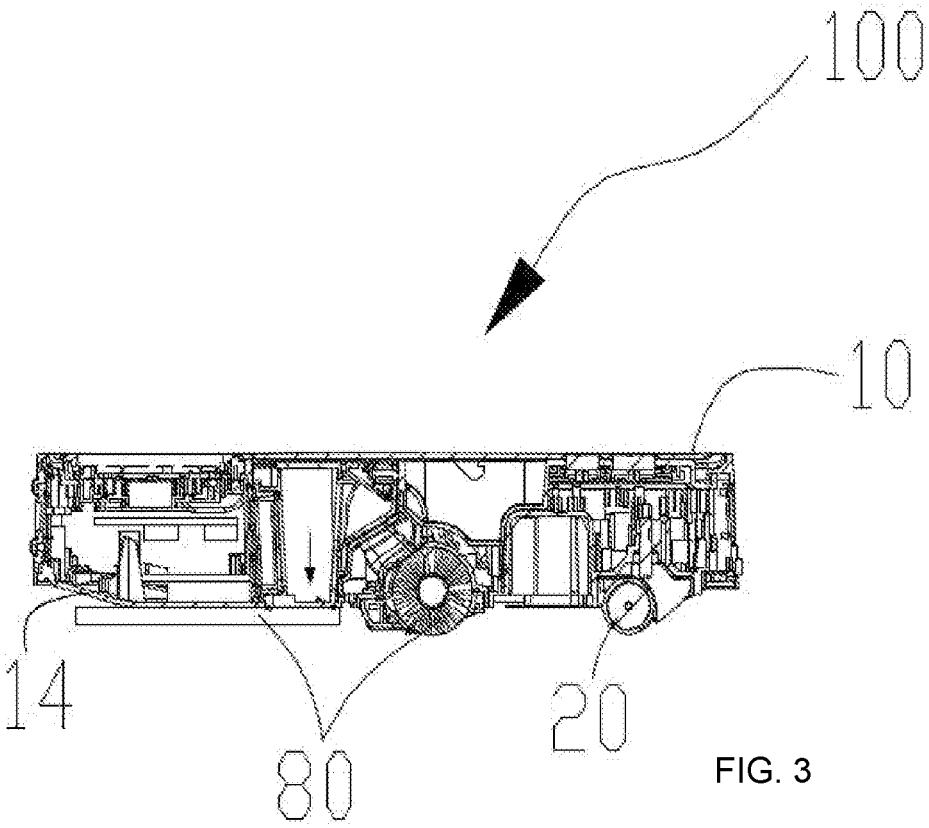
FIG. 3 is a second schematic sectional view of a cleaning robot according to an embodiment of the present disclosure.
Figure 4:
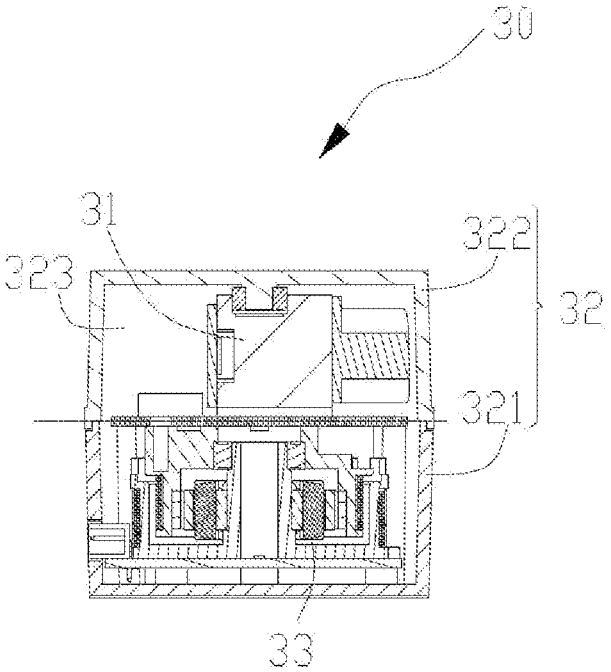
FIG. 4 is a schematic vertical-sectional view of a laser radar depicted in FIG. 1.
Figure 5:
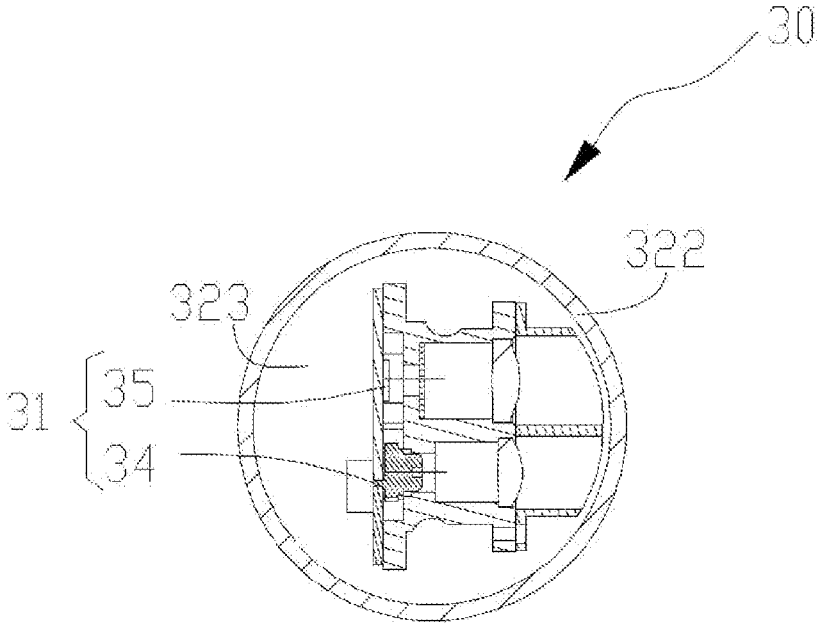
FIG. 5 is a schematic cross-sectional view of the laser radar depicted in FIG. 1.
Figure 9:
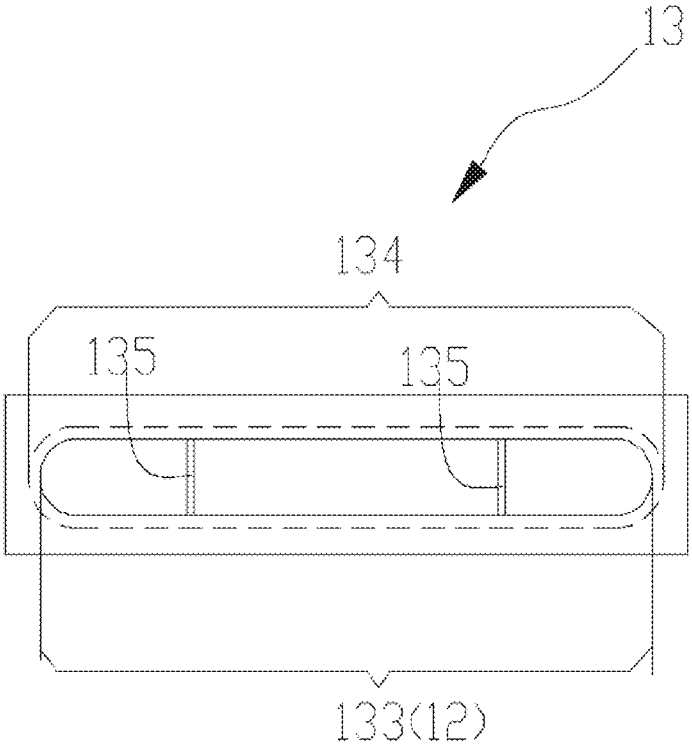
FIG. 9 is a schematic structural view of a collision side plate of a cleaning robot according to an embodiment of the present disclosure.
Figure 10:
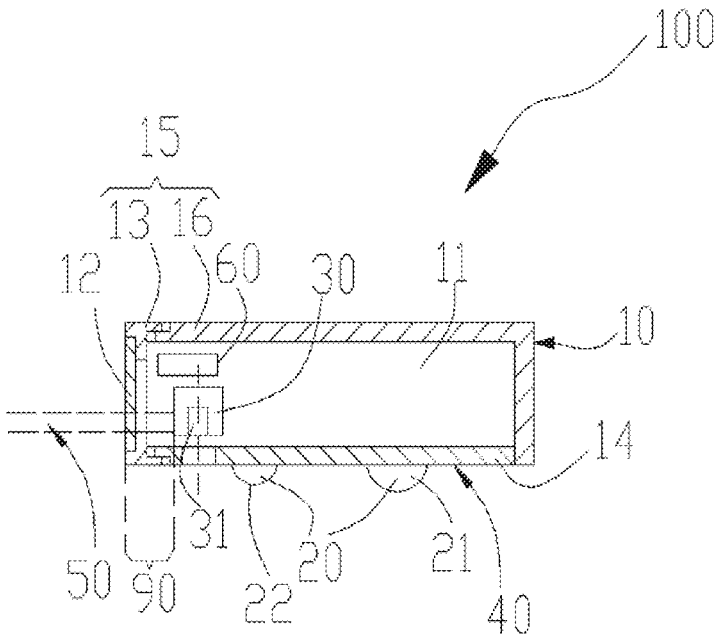
FIG. 10 is a second schematic sectional view of a cleaning robot according to an embodiment of the present disclosure.

Referring to FIGS. 1, 2, and 9, optionally, the collision side plate 13 is provided with a strip-shaped long hole 133, a light transmissive member 134 covering the strip-shaped long hole, and at least one reinforcing rib 135 disposed in the strip-shaped long hole 133. The at least one reinforcing rib 135 is combined with the light transmissive member 134.

In this embodiment, the collision side plate 13 is provided with the strip-shaped long hole 133 and the light transmissive member 134 covering the strip-shaped long hole 133. The strip-shaped long hole 133 has a relatively large length, to allow laser signals emitted and received by the laser radar 30 within the preset scanning angle X to pass therethrough. The light transmissive member 134 may be a plastic part. The light transmissive member 134 may transmit the laser signals passing through the strip-shaped long hole 133. A dark-colored filter layer is attached to the light transmissive member 134 to shield the devices located on an inner side of the collision side plate 13. The strip-shaped long hole 133 has two long sides 136 disposed opposite to each other and two short sides 137 disposed opposite to each other, and the two long sides 136 are connected to the two short sides 137, respectively. The at least one reinforcing rib 135 is fixedly connected to the two long sides 136 and combined with the light transmissive member 134, so that the at least one reinforcing rib 135 supports the two long sides 136 and the light transmissive member 134, thereby advantageously increasing the overall strength of the collision side plate 13 and avoiding deformation of the strip-shaped long hole 133 and the light transmissive member 134. One or more reinforcing ribs 135 may be provided and may be set as required.

Referring to FIGS. 1, 6, 10, and 11, optionally, a plane at the bottom of the robot body 10 is defined as a reference plane 40. A scanning optical path region 50 is formed by a region through which the laser signals emitted and received by the ranging component 31 pass within the preset scanning angle X. The cleaning robot 100 further comprises a sensing component 60 fixedly connected to the robot body. The sensing component 60 is adjacent to the laser radar 30. The sensing component 60 is disposed staggered from the scanning optical path region 50 of the ranging component 31 in a direction perpendicular to the reference plane 40.

In this embodiment, the reference plane 40 is provided on the chassis 14, and the reference plane 40 is located on a side of the chassis 14 facing away from the upper cover component 15. The scanning optical path region 50 of the ranging component 31 is substantially parallel to the reference plane 40. Since the preset scanning angle X is greater than or equal to 180°, the scanning optical path region 50 should occupy a part of the space of the inner cavity 11, so as to avoid blockage of the scanning optical path of the laser radar 30 by the sensing component 60. The sensing component 60 is disposed staggered from the scanning optical path region 50 of the ranging component 31 in the direction perpendicular to the reference plane 40, so that the sensing component 60 is mounted at a height different from the scanning optical path region 50 of the ranging component 31, whereby the sensing component 60 can be kept clear of the scanning optical path region 50 of the laser radar 30, so as to ensure the normal operation of the ranging component 31 within a preset angle range. Here, the sensing component 60 may include any one or more of an obstacle avoidance sensor(s) 61, a collision detection sensor(s) 62, a cliff detection sensor(s) 63, and the like, and may be set according to actual requirements.

Here, the robot body 10 has an arrangement region 90 overlapping with the scanning optical path region 50. The arrangement region 90 is adjacent to the collision side plate 13. The arrangement region 90 is located below the scanning optical path region 50. The orthographic projection of the sensing component 60 on the chassis 14 is at least partially located within the arrangement region 90, so that the sensing component 60 at least partially overlaps with the scanning optical path region 50, whereby the sensing component 60 and the laser radar 30 are arranged as a compact structure, occupying a small space inside the robot body 10. This facilitates an optimized arrangement of the devices inside the cleaning robot 100, achieves an optimized size design, and allows the laser radar 30 to easily achieve a wide-angle scanning optical path. In other embodiments, the orthographic projection of the sensing component 60 on the chassis 14 is completely staggered from the arrangement region 90.

Referring to FIGS. 10 to 14, optionally, the sensing component 60 includes at least one obstacle avoidance sensor 61, and the distance between the at least one obstacle avoidance sensor 61 and the reference plane 40 is greater than or less than the distance between the scanning optical path region 50 and the reference plane 40.

In this embodiment, the at least one obstacle avoidance sensor 61 may emit an obstacle detection signal to the outside. The obstacle detection signal is reflected by an external obstacle to form a reflected signal. The obstacle avoidance sensor 61 receives the reflected signal and determines the status of the obstacle in front of the cleaning robot 100 according to the reflected signal. The obstacle avoidance sensor 61 may be a 3D obstacle avoidance sensor. The obstacle avoidance sensor 61 may emit an obstacle detection signal to detect surrounding obstacles. The region of emission from the obstacle avoidance sensor 61 is formed at an angle relative to the reference plane 40, which may be an acute angle, a right angle, or an obtuse angle.

In this embodiment, three obstacle avoidance sensors 61 are provided. The at least one obstacle avoidance sensor 61 may include a first obstacle avoidance sensor and a second obstacle avoidance sensor. The first obstacle avoidance sensor and the second obstacle avoidance sensor are located on the left and right sides of the laser radar 30, respectively, and the first obstacle avoidance sensor and the second obstacle avoidance sensor are configured to detect obstacles on the two sides in front of the cleaning robot 100, respectively. The at least one obstacle avoidance sensor 61 includes a third obstacle avoidance sensor, which is configured to detect an obstacle on the left or right side of the cleaning robot 100. The third obstacle avoidance sensor may be used as a wall following sensor. In other embodiments, one or more than three obstacle avoidance sensors 61 are provided, and the number of the obstacle avoidance sensors may be set according to actual requirements.

In some optional embodiments, the orthographic projection of the at least one obstacle avoidance sensor 61 on the chassis 14 is at least partially located within the arrangement region 90, so that the at least one obstacle avoidance sensor 61 and the laser radar 30 are arranged as a compact structure, occupying a small space.

Referring to FIGS. 10 to 13, in one embodiment, the distance between the at least one obstacle avoidance sensor 61 and the reference plane 40 is greater than the distance between the scanning optical path region 50 and the reference plane 40. Here, if there is a greater distance between the at least one obstacle avoidance sensor 61 and the reference plane 40, there is a greater distance between the at least one obstacle avoidance sensor 61 and the ground, and thus the measurement accuracy of the at least one obstacle avoidance sensor 61 is more advantageously ensured. A space is provided between the at least one obstacle avoidance sensor 61 and the chassis 14, and the scanning optical path region 50 of the ranging component 31 is located within the above space, so that the at least one obstacle avoidance sensor 61 is disposed staggered from the scanning optical path region 50 of the ranging component 31, whereby the laser radar 30 can easily achieve a wide-angle scanning optical path. It can be understood that the at least one obstacle avoidance sensor 61 may be accommodated in the inner cavity 11, or alternatively, the at least one obstacle avoidance sensor 61 may be protrudingly disposed on a side of the main housing 16 facing away from the chassis 14, and hence the at least one obstacle avoidance sensor 61 may occupy a reduced space of the inner cavity 11.

Moreover, there are two ways to mount the laser radar 30 in the robot body 10.

Figure 12:
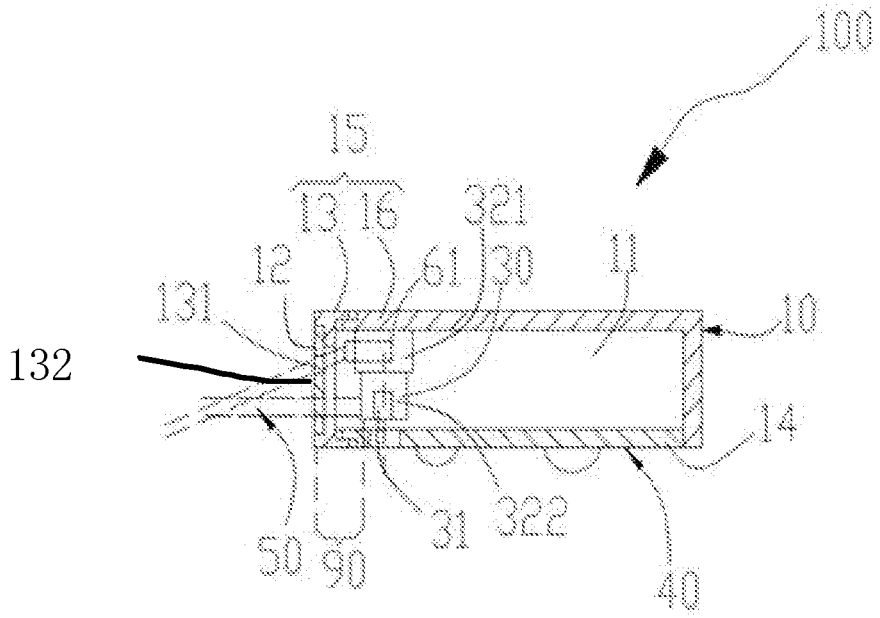
FIG. 12 is a third schematic sectional view of a cleaning robot according to an embodiment of the present disclosure.

With continued reference to FIG. 12, in the first way, the base 321 of the laser radar 30 is disposed adjacent to the chassis 14, and both the ranging component 31 and the light transmissive cover 322 of the laser radar 30 are disposed adjacent to the main housing 16. In other words, the laser radar 30 is mounted upright, so that the scanning optical path region 50 of the ranging component 31 is distanced from the reference plane 40 by a first height.

Figure 13:
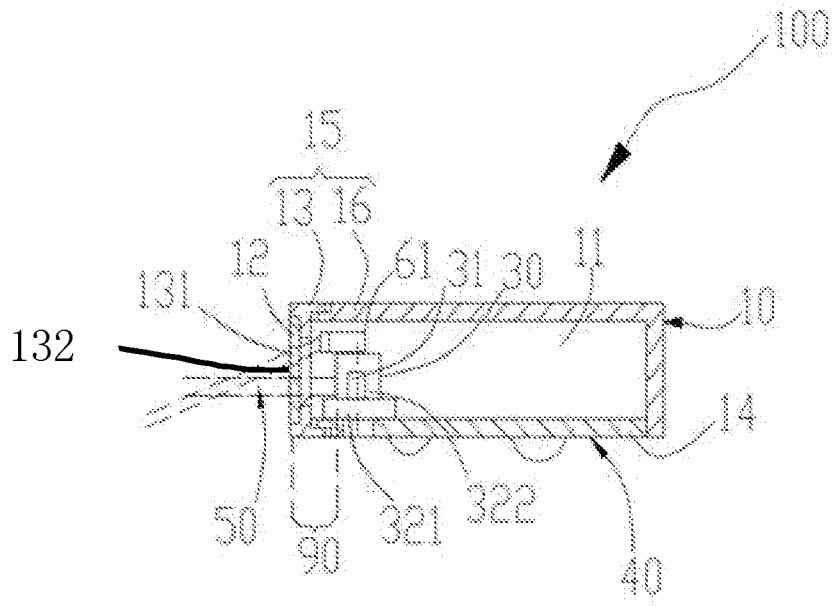
FIG. 13 is a fourth schematic sectional view of a cleaning robot according to an embodiment of the present disclosure.

With continued reference to FIG. 13, in the second way, the base 321 of the laser radar 30 is disposed adjacent to the main housing 16, and both the ranging component 31 and the light transmissive cover 322 of the laser radar 30 are disposed adjacent to the chassis 14. In other words, the laser radar 30 is mounted upside down, so that the scanning optical path region 50 of the ranging component 31 is distanced from the reference plane 40 by a second height. For the same laser radar 30, the second height is less than the first height, so that the at least one obstacle avoidance sensor 61 can be mounted at a required reduced height, thereby facilitating a reduction in the overall height dimension of the cleaning robot 100.

Figure 14:
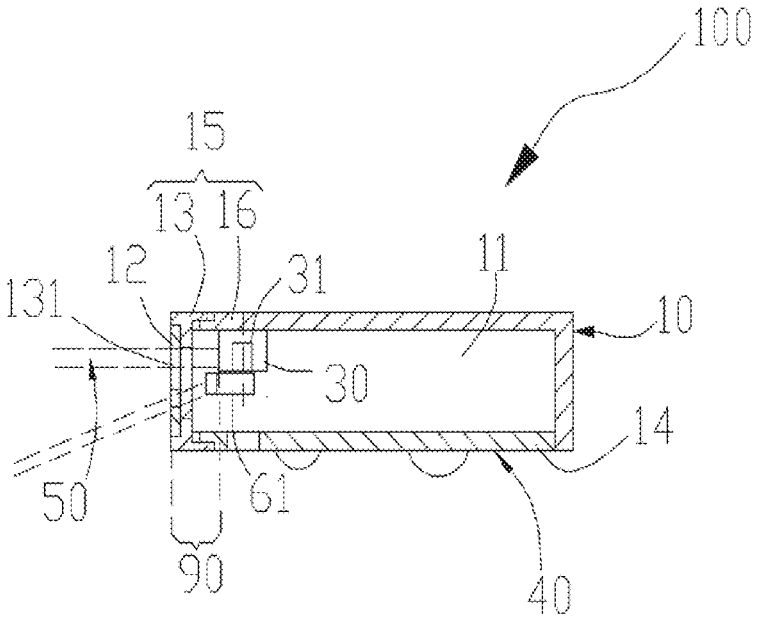
FIG. 14 is a fifth schematic sectional view of a cleaning robot according to an embodiment of the present disclosure.

With continued reference to FIG. 14, in another embodiment, the distance between the at least one obstacle avoidance sensor 61 and the reference plane 40 is less than the distance between the scanning optical path region 50 and the reference plane 40. Here, a space is provided between the scanning optical path region 50 of the ranging component 31 and the chassis 14, and the at least one obstacle avoidance sensor 61 is located within the above space, so that the at least one obstacle avoidance sensor 61 is disposed staggered from the scanning optical path region 50 of the ranging component 31. The at least one obstacle avoidance sensor 61 may be located directly below, or on the left or right side below the ranging component 31.

Referring to FIGS. 11, 12, 15, 16, and 17, optionally, the robot body 10 comprises a movable collision side plate 13. The light transmissive window 12 is provided in the collision side plate 13. The at least one obstacle avoidance sensor 61 is disposed spaced apart from the collision side plate 13, and the collision side plate 13 is provided with a light transmissive hole 131 at a position corresponding to the obstacle avoidance sensor 61. Alternatively, the at least one obstacle avoidance sensor 61 is hermetically connected to the collision side plate 13, and the collision side plate 13 is provided with a light transmissive portion 132 at a position corresponding to the obstacle avoidance sensor 61.

Figure 15:
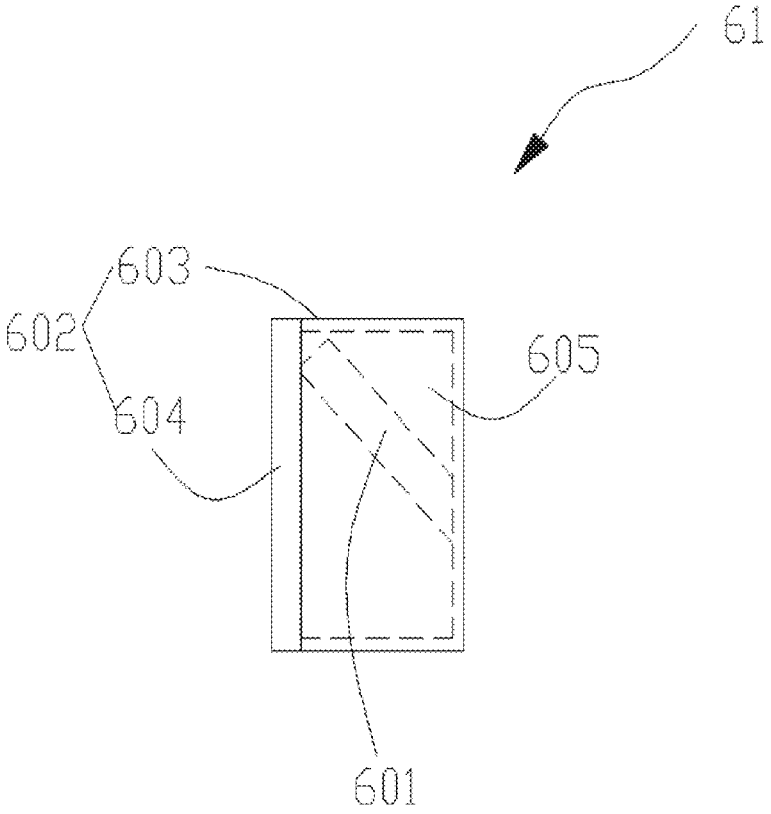
FIG. 15 is a schematic structural view of an obstacle avoidance sensor of a cleaning robot according to an embodiment of the present disclosure.

With continued reference to FIGS. 12 and 15, in this embodiment, the at least one obstacle avoidance sensor 61 is disposed spaced apart from the collision side plate 13, and the collision side plate 13 is provided with a light transmissive hole 131 at a position corresponding to the obstacle avoidance sensor 61. The at least one obstacle avoidance sensor 61 may be fixedly connected to the main housing 16 or to the chassis 14, thus the at least one obstacle avoidance sensor 61 is fixed relative to the chassis 14 and the main housing 16. In a state where the collision side plate 13 is expanded relative to the main housing 16, there is a maximum space between the collision side plate 13 and the at least one obstacle avoidance sensor 61 that is greater than a stroke of movement of the collision side plate 13 to avoid collision and damage of the at least one obstacle avoidance sensor 61 by the collision side plate 13. Each of the obstacle avoidance sensors 61 comprises a sensor body 601 and a packaging component 602. The packaging component 602 comprises a packaging base 603 and an optical lens 604 covering the packaging base 603. A sealed space 605 for accommodating the sensor body 601 is formed between the packaging base 603 and the optical lens 604. The optical lens 604 can transmit signals emitted and received by the sensor body 601, and at the same time, the optical lens 604 can provide a dustproof effect to avoid contamination of the sensor body by external dust. The collision side plate 13 is provided with a light transmissive hole 131 at a position corresponding to each of the obstacle avoidance sensors 61, so that each of the obstacle avoidance sensors 61 emits an obstacle detection signal and receives a reflected signal through the light transmissive hole 131 provided at the corresponding position. The number of the light transmissive holes 131 is the same as the number of the obstacle avoidance sensors 61.

Figure 16:
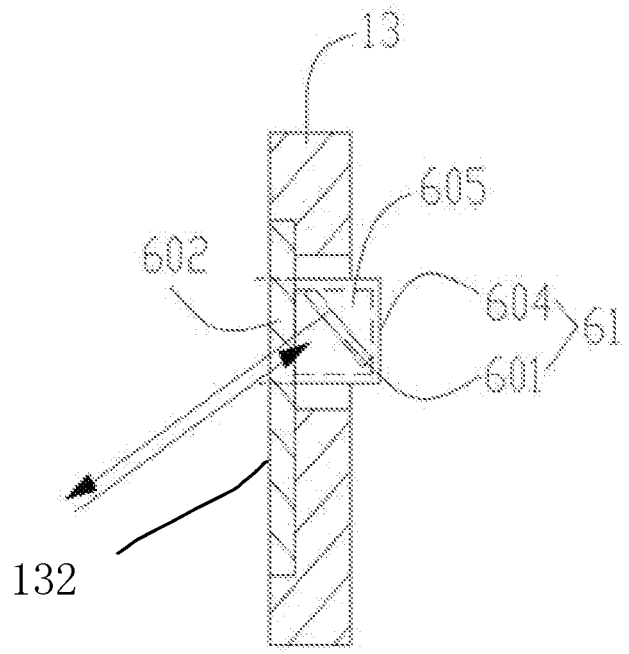
FIG. 16 is a first schematic view showing an assembled structure of a collision side plate and an obstacle avoidance sensor according to an embodiment of the present disclosure.
Figure 17:
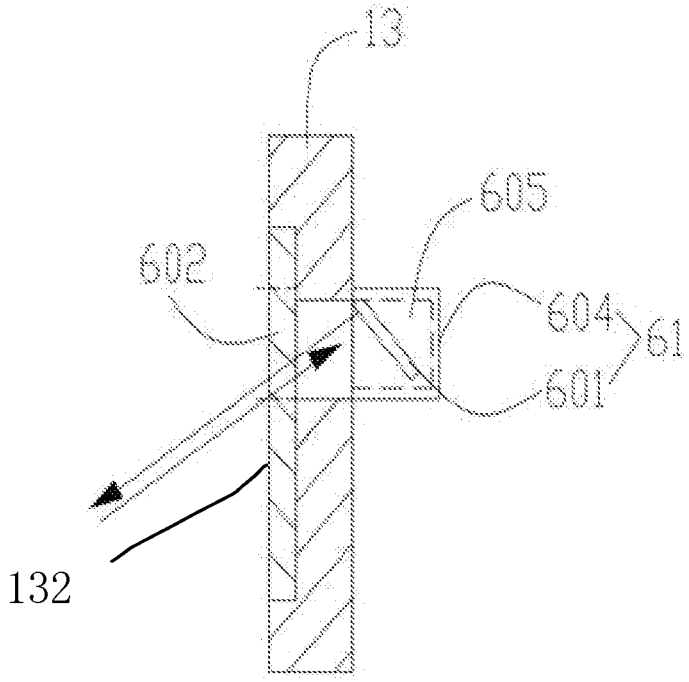
FIG. 17 is a second schematic view showing an assembled structure of a collision side plate and an obstacle avoidance sensor according to an embodiment of the present disclosure.

With continued reference to FIGS. 12, 16, and 17, in other embodiments, the collision side plate 13 is provided with a light transmissive portion 132 at a position corresponding to the obstacle avoidance sensor 61, and the at least one obstacle avoidance sensor 61 is hermetically connected to the collision side plate 13. Here, the obstacle avoidance sensor 61 comprises a sensor body 601 and a packaging base 604. The packaging base 604 is hermetically connected to the package side plate, so that a sealed space 605 for accommodating the sensor body 601 is formed between the packaging base 604 and the collision side plate 13. The light transmissive portion 132 can transmit signals emitted and received by the obstacle avoidance sensor 61, and at the same time can provide a dustproof effect to avoid contamination of the sensor body 601 by external dust. The light transmissive portion 132 is formed by a part of the light transmissive member, which can reduce the number of openings in the collision side plate 13, to give a more simplified appearance. One or two or more obstacle avoidance sensors 61 may be provided.

Figure 11:
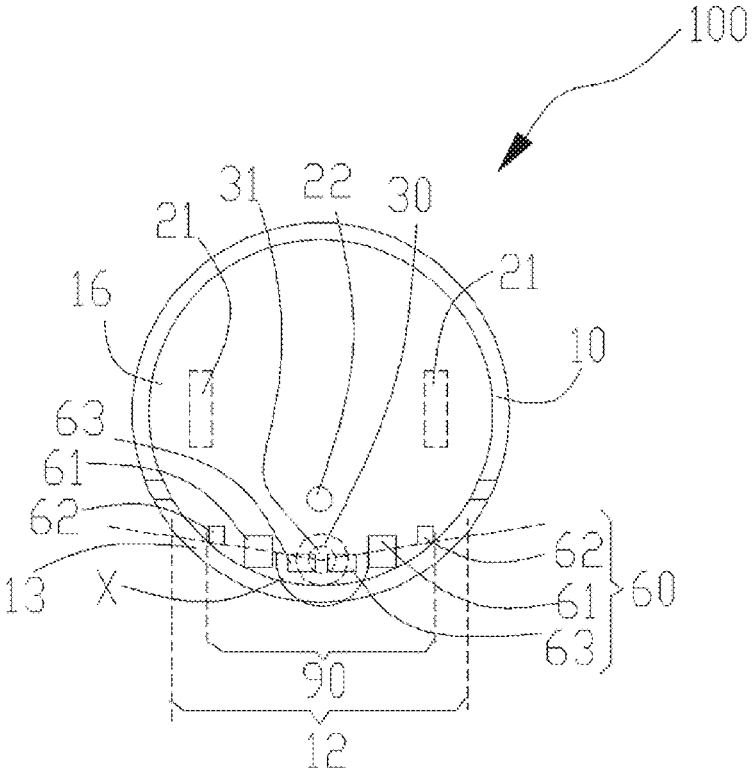
FIG. 11 is a third schematic structural top view of a cleaning robot according to an embodiment of the present disclosure.
Figure 18:
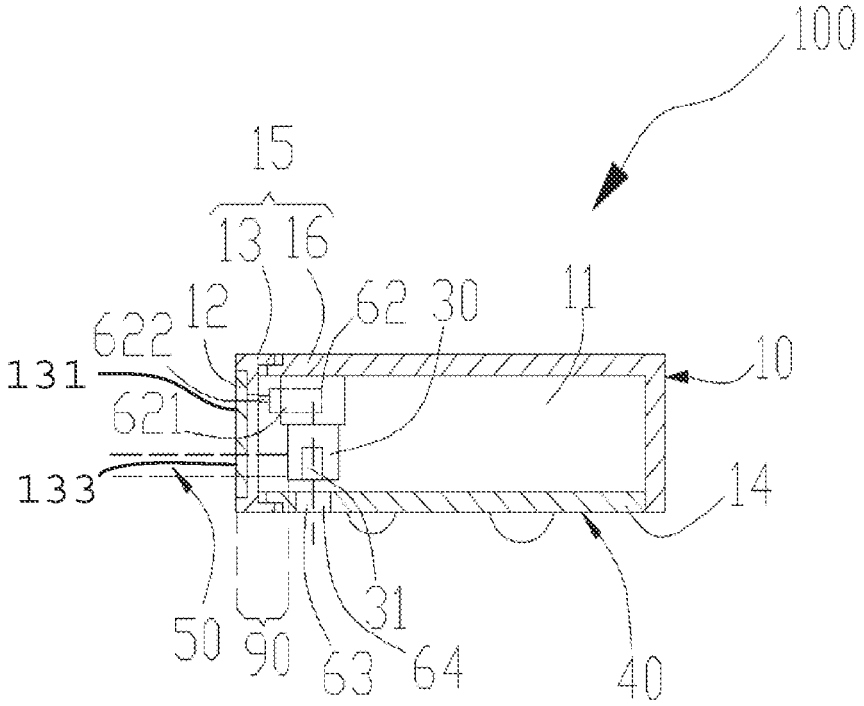
FIG. 18 is a sixth schematic sectional view of a cleaning robot according to an embodiment of the present disclosure.
Figure 19:
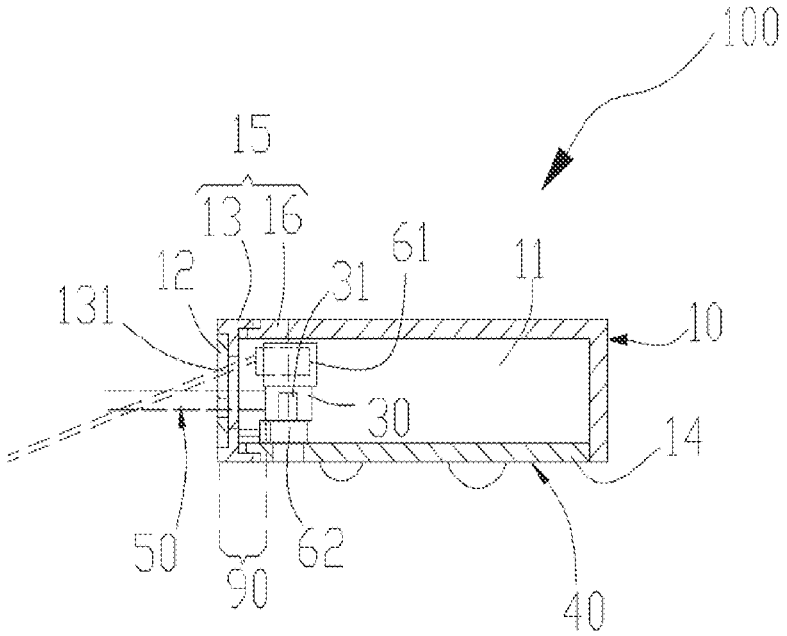
FIG. 19 is a seventh schematic sectional view of a cleaning robot according to an embodiment of the present disclosure.

Referring to FIGS. 11, 18, and 19, optionally, the sensing component 60 includes at least one collision detection sensor 62. The distance between the at least one collision detection sensor 62 and the reference plane 40 is greater than or less than the distance between the scanning optical path region 50 and the reference plane 40.

In this embodiment, the collision detection sensor 62 comprises a collision detection body 621 and a trigger 622 movably connected to the collision detection body 621. The collision detection body 621 is fixedly connected to the main housing 16 or to the chassis 14. The trigger 622, at one end thereof remote from the collision detection body 621, abuts against the collision side plate 13. In the state where the collision side plate 13 is expanded relative to the main housing 16, namely, in a state where the cleaning robot 100 has not collided with an obstacle, the trigger 622 is in a first position, and the trigger 622 does not trigger an operation of the collision detection body 621. When the collision side plate 13 is retracted relative to the main housing 16, the collision side plate 13 drives the trigger 622 to move to a second position relative to the main body of the collision side plate 13, the trigger 622 triggers the collision detection body 621 to generate a collision signal, and then the cleaning robot 100 determines the presence of an obstacle from the collision signal. In this embodiment, two collision detection sensors 62 are provided. The at least one collision detection sensor 62 may include a first collision detection sensor and a second collision detection sensor. The first collision detection sensor and the second collision detection sensor are located on the left and right sides of the laser radar 30, respectively, and the first collision detection sensor and the second collision detection sensor are configured to detect the collision of the left and right sides of the collision side plate 13 with obstacles, respectively. In other embodiments, one or more than two obstacle avoidance sensors 61 may be provided, and the number of the obstacle avoidance sensors may be set according to actual requirements.

In some optional embodiments, the at least one collision detection sensor 62 and the at least one obstacle avoidance sensor 61 are located on substantially the same plane, which facilitates a reduction in the overall height dimension of the cleaning robot 100.

In some optional embodiments, the orthographic projection of the at least one collision detection sensor 62 on the chassis 14 is at least partially located within the arrangement region 90, so that the at least one collision detection sensor 62 and the laser radar 30 are arranged as a compact structure, occupying small space.

Referring to FIGS. 11 and 18, in one embodiment, the distance between the at least one collision detection sensor 62 and the reference plane 40 is greater than the distance between the scanning optical path region 50 and the reference plane 40. Here, a space is provided between the at least one collision detection sensor 62 and the chassis 14, and the scanning optical path region 50 of the ranging component 31 is located within the above space, so that the at least one collision detection sensor 62 is disposed staggered from the scanning optical path region 50 of the ranging component 31, whereby the laser radar 30 can easily achieve a wide-angle scanning optical path.

In this embodiment, there are two ways to mount the laser radar 30 in the robot body 10 described above, which can be understood with reference to the foregoing description and will not be described in detail here.

Referring to FIGS. 11 and 19, in another embodiment, the distance between the at least one collision detection sensor 62 and the reference plane 40 is less than the distance between the scanning optical path region 50 and the reference plane 40. Here, a space is provided between the scanning optical path region 50 of the ranging component 31 and the chassis 14, and the at least one collision detection sensor 62 is located within the above space, so that the at least one collision detection sensor 62 is disposed staggered from the scanning optical path region 50 of the ranging component 31. The at least one collision detection sensor 62 may be located directly below, or on the left or right side below the ranging component 31.

Referring to FIGS. 11 and 18, optionally, the sensing component 60 includes at least one cliff detection sensor 63. The distance between the at least one cliff detection sensor 63 and the reference plane 40 is less than the distance between the scanning optical path region 50 and the reference plane 40.

In this embodiment, the at least one cliff detection sensor 63 is mounted at the front end of the chassis 14 and adjacent to the collision side plate 13. The at least one cliff detection sensor 63 is configured to sense a terrain with a height difference. For example, when the cleaning robot 100 travelling on the ground encounters a stepped surface, the at least one cliff detection sensor 63 may sense the stepped surface, and the cleaning robot 100 may stop moving or retreat to avoid falling of the cleaning robot 100 from the above stepped surface. One or two or more cliff detection sensors 63 may be provided, and the number of the cliff detection sensors may be set according to actual requirements. The distance between the at least one cliff detection sensor 63 and the reference plane 40 is less than the distance between the scanning optical path region 50 and the reference plane 40, whereby the cliff detection sensor 63 may be located directly below, or on the left or right side below the laser radar 30, so that the at least one cliff detection sensor 63 is kept clear of the scanning optical path of the ranging component 31, thereby allowing the laser radar 30 to easily achieve a wide-angle scanning optical path.

In some optional embodiments, the orthographic projection of the at least one cliff detection sensor 63 on the chassis 14 is at least partially located within the arrangement region 90, so that the at least one cliff detection sensor 63 and the laser radar 30 are arranged as a compact structure, occupying small space.

Referring to FIGS. 11 and 18, optionally, at least one through hole 64 is provided at a position, corresponding to the laser radar 30, at the bottom of the robot body 10, and the at least one cliff detection sensor 63 is mounted in the at least one through hole 64, respectively.

In this embodiment, one or two or more cliff detection sensors 63 may be provided, and the number of the through holes 64 is the same as the number of the cliff detection sensors 63. The at least one through hole 64 is provided at a position of the chassis 14 corresponding to the laser radar 30. The at least one cliff detection sensor 63 is mounted in the at least one through hole 64, respectively, so that the at least one cliff detection sensor 63 and the laser radar 30 are disposed in a stacked manner. In this way, the at least one cliff detection sensor 63 and the laser radar 30 are arranged as a compact structure, occupying small space, while avoiding blockage of the scanning optical path of the laser radar 30 by the at least one cliff detection sensor 63, thereby allowing the laser radar 30 to easily achieve a wide-angle scanning optical path.

In the description of this specification, a reference term such as "one embodiment", "some embodiments", "an example", "a specific example", or "some examples" is described to mean that a specific feature, structure, material, or characteristic described in connection with the embodiment or example is included in at least one embodiment or example of the present disclosure. In this specification, the indicative representation of the above terms does not necessarily refer to the same embodiments or examples. Moreover, the described specific features, structures, materials, or characteristics can be combined in an appropriate manner in any one or more embodiments or examples.

The embodiments described above are not intended to limit the scope of the technical solutions as claimed. Any modifications, equivalent alternatives, improvements and so on made within the spirit and principle of the above embodiments are to be included in the scope of the technical solutions as claimed.

What is claimed is:

1. A cleaning robot, comprising:

a robot body with an inner cavity;

a light transmissive window formed in a side wall of the inner cavity of the robot body;

a traveling mechanism mounted at a bottom of the robot body to drive the robot body to move;

a cleaning component detachably connected to the robot body and configured to clean a surface through which the robot body passes;

a laser radar mounted in the inner cavity, the laser radar comprising a ranging component rotatable relative to the robot body, wherein the ranging component emits and receives laser signals via the light transmissive window within a preset scanning angle, wherein the ranging component emits a detection signal through the light transmissive window, the detection signal is reflected upon encountering an obstacle to form a reflected signal, and the reflected signal is returned to the ranging component through the light transmissive window;

wherein a plane at the bottom of the robot body is defined as a reference plane, and a scanning optical path region is formed by a region through which the laser signals emitted and received by the ranging component pass within the preset scanning angle;

further comprising a sensing component fixedly connected to the robot body adjacent to the laser radar and disposed staggered from the scanning optical path region of the ranging component in a direction perpendicular to the reference plane; and wherein the sensing component comprises at least one obstacle avoidance sensor, wherein a first distance between the at least one obstacle avoidance sensor and the reference plane is greater than or less than a second distance between the scanning optical path region and the reference plane;

wherein the robot body comprises a movable collision side plate, the collision side plate provided with the light transmissive window, wherein either:

the at least one obstacle avoidance sensor is disposed spaced apart from the collision side plate, and the collision side plate is provided with a light transmissive hole at a position corresponding to each of the at least one obstacle avoidance sensor, or the at least one obstacle avoidance sensor is hermetically provided and connected to the collision side plate, and the collision side plate is provided with a light transmissive portion at the position corresponding to the at least one obstacle avoidance sensor.

2. The cleaning robot according to claim 1, wherein the preset scanning angle is greater than or equal to 180°.

3. The cleaning robot according to claim 1, wherein the sensing component further comprises at least one collision detection sensor, wherein a second distance between the at least one collision detection sensor and the reference plane is greater than or less than a distance between the scanning optical path region and the reference plane.

4. The cleaning robot according to claim 3, wherein the robot body comprises a chassis, and a first space is provided between the at least one collision detection sensor and the chassis, and the scanning optical path region of the ranging component is located within the above first space, or alternatively, a second space is provided between the scanning optical path region of the ranging component and the chassis, and the at least one collision detection sensor is located within the above second space.

5. The cleaning robot according to claim 1, wherein the sensing component further comprises at least one cliff detection sensor, wherein a third distance between the at least one cliff detection sensor and the reference plane is less than the second distance between the scanning optical path region and the reference plane.

6. The cleaning robot according to claim 5, wherein at least one through hole is provided at a position, corresponding to the laser radar, at the bottom of the robot body, and the at least one cliff detection sensor is mounted in the at least one through hole, respectively.

7. The cleaning robot according to claim 1, wherein the robot body comprises a chassis, the travelling mechanism comprises a pair of driving wheels disposed on the chassis, wherein the pair of driving wheels is mounted on a middle position of the chassis, the laser radar is located at a front end of the chassis, and the laser radar and the pair of driving wheels are distributed in a triangle shape.

8. The cleaning robot according to claim 7, wherein the travelling mechanism comprises at least one wheel disposed on the chassis, wherein the at least one wheel is mounted at a rear end of the chassis opposite to the front end.

9. The cleaning robot according to claim 7, further comprising a main circuit board disposed on the chassis, wherein the main circuit board has a front edge adjacent to the laser radar, and the front edge is partially recessed to form a notch, in which the laser radar is at least partially accommodated.

10. The cleaning robot according to claim 1, wherein the laser radar further comprises a housing component fixedly connected to the robot body, and a driving component fixedly connected to the housing component, wherein the driving component is capable of driving the ranging component to rotate, the ranging component comprises a laser emitter and a single photon detection chip, wherein a light emitting path of the laser emitter and a light receiving path of the single photon detection chip are located on a plane perpendicular to a direction of an axis of rotation of the ranging component, and the light emitting path of the laser emitter is parallel to the light receiving path of the single photon detection chip.

11. The cleaning robot according to claim 1, wherein the laser radar is mounted upright, so that the scanning optical path region of the ranging component is distanced from the reference plane by a first height, or alternatively, the laser radar is mounted upside down, so that the scanning optical path region of the ranging component is distanced from the reference plane by a second height, wherein the second height is less than the first height.

12. The cleaning robot according to claim 1, wherein the robot body comprises a chassis and an upper cover component, the upper cover component detachably mounted on the chassis, wherein the inner cavity is formed between the chassis and the upper cover component;

wherein the upper cover component comprises a main housing and the collision side plate movably connected to the main housing, the main housing covering the chassis together with the collision side plate, wherein in a position of the collision side plate is expanded relative to the main housing, a space greater than or equal to a stroke of movement of the collision side plate is provided between the collision side plate and the laser radar.

13. The cleaning robot according to claim 12, wherein the cleaning robot further comprises an elastic member that elastically connects the chassis and the collision side plate, the elastic member providing an elastic supporting force to the collision side plate.

14. The cleaning robot according to claim 12, wherein the collision side plate is provided with a strip-shaped long hole to allow the laser signals emitted and received by the laser radar, a light transmissive member covering the strip-shaped long hole, and at least one reinforcing rib disposed in the strip-shaped long hole.

15. The cleaning robot according to claim 1, wherein the at least one obstacle avoidance sensor includes a first obstacle avoidance sensor and a second obstacle avoidance sensor, and the first obstacle avoidance sensor and the second obstacle avoidance sensor are located on left and right sides of the laser radar, respectively, and the first obstacle avoidance sensor and the second obstacle avoidance sensor are configured to detect obstacles on two sides in front of the cleaning robot.

16. The cleaning robot according to claim 1, wherein the robot body comprises a chassis, and wherein there is either:

a first space is provided between the at least one obstacle avoidance sensor and the chassis, and the scanning optical path region of the ranging component is located within the above first space, or a second space is provided between the scanning optical path region of the ranging component and the chassis, and the at least one obstacle avoidance sensor is located within the above second space.

17. The cleaning robot according to claim 1, wherein the robot body has an arrangement region overlapping with the scanning optical path region, and an orthographic projection of the sensing component on a chassis is at least partially located within the arrangement region.

* * * * *